US008515108B2

(12) United States Patent
Allen

(10) Patent No.: US 8,515,108 B2
(45) Date of Patent: Aug. 20, 2013

(54) INPUT SELECTION FOR AUDITORY DEVICES

(75) Inventor: Felicity Allen, Artarmon (AU)

(73) Assignee: Cochlear Limited, Macquarie University, NSW (AU)

( * ) Notice: Subject to any disclaimer, the term of this patent is extended or adjusted under 35 U.S.C. 154(b) by 519 days.

(21) Appl. No.: 12/664,867

(22) PCT Filed: Jun. 16, 2008

(86) PCT No.: PCT/AU2008/000867

§ 371 (c)(1),
(2), (4) Date: May 21, 2010

(87) PCT Pub. No.: WO2008/151392

PCT Pub. Date: Dec. 18, 2008

(65) Prior Publication Data

US 2010/0310082 A1 Dec. 9, 2010

(30) Foreign Application Priority Data

Jun. 15, 2007 (AU) ..... 2007903216

(51) Int. Cl.
*H04R 25/00* (2006.01)

(52) U.S. Cl.
USPC ..... 381/312; 381/316

(58) Field of Classification Search
USPC ..... 381/312–313, 315–317, 320–321
See application file for complete search history.

(56) References Cited

U.S. PATENT DOCUMENTS

| | | | | |
|---|---|---|---|---|
| 4,852,175 | A | 7/1989 | Kates | |
| 5,663,727 | A | 9/1997 | Vokac | |
| 6,240,192 | B1 * | 5/2001 | Brennan et al. | 381/314 |
| 6,768,801 | B1 | 7/2004 | Wagner et al. | |
| 2005/0078842 | A1 | 4/2005 | Vonlanthen et al. | |

FOREIGN PATENT DOCUMENTS

| | | |
|---|---|---|
| EP | 764937 | 3/1997 |
| WO | 9822937 A1 | 5/1998 |
| WO | 9931655 | 6/1999 |

OTHER PUBLICATIONS

International Search Report. PCT/AU2008/000867. Mailed Nov. 10, 2008.

EP08756947.1 , "Supplemental European Search Report Received", mailed Dec. 17, 2012, 8 pages.

Kates , "Classification of background noises for hearing-aid applications.", The Journal of the Acoustical Society of America, vol. 97, No. 1,, Jan. 1, 1995, 461.

* cited by examiner

*Primary Examiner* — Suhan Ni
(74) *Attorney, Agent, or Firm* — Kilpatrick, Townsend & Stockton, LLP.

(57) ABSTRACT

A method and auditory device for automatic evaluation of an input signal for use in an auditory device, the method including the steps of: detecting a signal; processing the signal to determine one or more shape parameters relevant to the change of spectral shape over time of said signal, and the signal level; and on the basis of the shape parameter and the signal level, and a predetermined set of rules, evaluating whether said signal is a useful input signal for said device.

31 Claims, 9 Drawing Sheets

INPUT SELECTION FOR AUDITORY DEVICES

CROSS-REFERENCE TO RELATED APPLICATIONS

This application is a national stage application under 35 USC §371 (c) of PCT Application No. PCT/AU2008/000867, entitled "INPUT SELECTION FOR AUDITORY DEVICES," filed on Jun. 16, 2008, which claims priority from Australian Patent Application No. 2007903216, filed on Jun. 15, 2007. The entire disclosure and contents of the above applications are hereby incorporated by reference herein.

BACKGROUND

1. Field of the Invention

The present invention relates to the assessment of a signal as an input for an auditory device, and to the selection between possible inputs.

2. Related Art

Auditory devices include any acoustic or electrical auditory devices, such as hearing aids, middle ear implants, intracochlear implants, brain stem implants, implanted acoustic devices or any combination of these, for example devices providing combined electrical and acoustic stimulation. For those devices having an external device and an implanted device, the external device may be continuously, intermittently or occasionally in communication with the implanted device.

Auditory devices require, as an input, an electrical signal corresponding to an audio signal for processing in the device. This input is most commonly provided by a microphone. For example, a conventional cochlear implant consists of an external part containing a microphone, a sound processor and a transmitter, and an internal part which contains a receiver/stimulator device and an electrode array. Sound enters the microphone, which outputs a corresponding electrical signal to the sound processor, which in turn codes the sound using one of many possible processing strategies. The coded signal is sent to the transmitter, which sends it to the implanted receiver/stimulator unit. The receiver/stimulator sends the corresponding stimuli to the appropriate electrodes, so as to provide a percept of hearing for a user.

It will be apparent that the quality of outcomes for the user is dependant upon the quality of the detected audio signal. The quality of sound detected by a microphone can be unsatisfactory for the user particularly when in noisy environments, for example, when talking on the phone, or in movie theatres, sports stadiums, churches, and the like. This is generally due to a combination of factors including limitations in speech processing strategies, and the inability of such devices to overcome background noise, to detect signals at a distance from the source or to accurately convey the directionality of sound.

A telecoil acts as an alternate or supplemental input device to the auditory device, typically in noisy or difficult acoustic environments. A telecoil is a miniature receiver that picks up magnetic sound signals from telecoil-compatible phones and assistive listening systems (ALS). Telecoils are made up of a metal core around which ultra-fine wire is coiled. When the coil is placed in an electromagnetic field, a signal is induced in the wire. This signal can be used as an alternative input for the auditory devices.

Telecoils in many situations improve sound quality and allow different sound sources to be directly connected to the auditory aid. The telecoil is used to couple with the magnetic fields produced by telephones and hearing loops, assisting the user by tapping directly into a sound source and providing a clear signal free from audio background noise. In many situations, the telecoil signal may provide a clearer signal than the corresponding signal from the microphone on the user's auditory device. However, it will be appreciated that there may be noise or interference associated with the telecoil, so that in some situations the telecoil signal although present may not be the preferred input.

On most auditory devices, the input signal can be switched between the microphone and telecoil transducers. Such switching can be done via a user-operated manual switch, or automatically by the device itself. It is desirable to provide a feature in the device to decide when to select the telecoil input signal over one or more microphone input signals, that is, to choose the higher quality signal for the user.

One method for making such a decision employs a magnetically actuated switch to detect the presence of a static magnetic field such as that produced by the speaker in a fixed-line telephone. The primary limitation of this method is that it is incapable of detecting an induction loop signal such as that commonly found in cinemas, lecture theatres and hearing accessories, requiring manual switching in such cases. Such switches are also commonly not sensitive enough and require either careful placement very close to a phone handset or the addition of a supplementary magnet on the phone handset.

Another class of methods uses signal processing algorithms to distinguish whether an input telecoil signal contains a 'useful' signal such as speech or music and switches to it if such a 'useful' signal is detected. Measures of 'usefulness' have been made using standard methods for speech detection such as measures of signal amplitude, amplitude modulation depth and measures of amplitude variation in the spectral domain.

The main limitation of methods of this type is that they are not robust to changes in orientation or movement of the telecoil within a strong magnetic field. This is because the strength of the magnetic field detected by a telecoil is highly dependent on the orientation of the telecoil in that field. If the telecoil is oriented parallel to the magnetic field lines, it will pick up a high amplitude signal. If it is oriented perpendicular to the magnetic field lines, the signal amplitude will be relatively much lower. If the orientation of the telecoil is changed quickly with respect to a static magnetic noise signal, or if the direction of the magnetic field lines were to change, it is possible for the amplitude modulation of the detected signal to resemble that of a speech or music signal. If the wearer of a hearing device were to run, jump, dance or tumble, or if a mobile phone were brought near and moved around, it may cause such an amplitude modulation based signal analyzer to falsely trigger and erroneously select the telecoil signal.

Other input devices may be used for auditory devices. For example, two or more microphones may be provided for a device. These may be on the same side of the head, for example in different positions in the same behind the ear device, or disposed on different sides of the head or attached at various other positions on the user. Alternative inputs may also include radio or other wireless links. Similar issues arise for all such situations, in that a decision to use one or more possible inputs, or a combination of inputs, is required.

SUMMARY

In accordance with one aspect of the present invention, a method for automatic evaluation of an input signal for use in an auditory device is provided. The method comprises:

detecting a signal; processing said signal to determine one or more shape parameters relevant to the change of spectral shape over time of said signal, and the signal level; and on the basis of the shape parameter and the signal level, and a predetermined set of rules, evaluating whether said signal is a useful input signal for said device.

In accordance with a second aspect of the present invention, an auditory device adapted to automatically evaluate an input signal is provided. The auditory device comprises: a detector for detecting a signal, a processor for processing said signal to determine one or more shape parameters relevant to the change of spectral shape over time of said signal, and the signal level, and on the basis of the shape parameter and the signal level, and a predetermined set of rules, evaluating whether said signal is useful for said device.

BRIEF DESCRIPTION OF THE DRAWINGS

An illustrative embodiment of the present invention will be described with reference to the accompanying figures, in which.

DETAILED DESCRIPTION

Aspects of the present invention are applicable to any auditory device, which as discussed above is intended to be interpreted broadly. Various implementations and examples will be described, however, it will be appreciated that many other implementations are possible, and that the examples provided are intended to be illustrative only and not limiting.

Figure 1A:
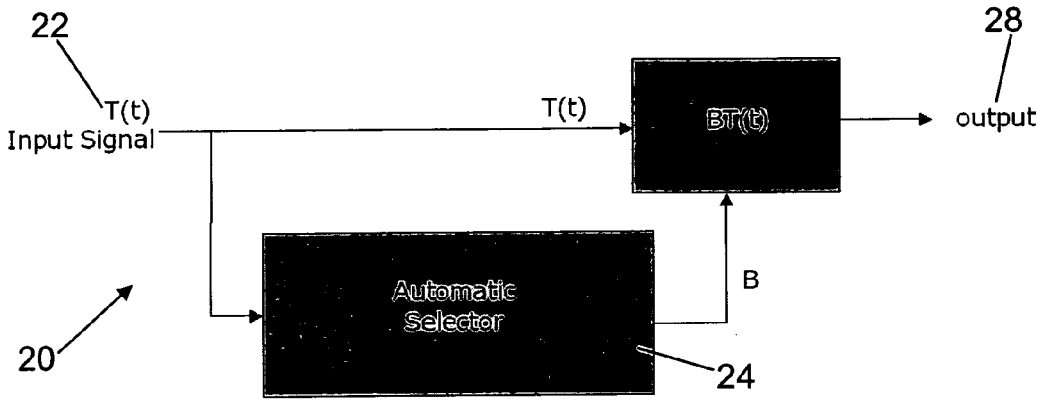
FIG. 1*a* is a block diagram overview of the system of one embodiment of the invention.

FIG. 1*a* is a block diagram overview of a system 20 of one embodiment where an input signal T(t), 22, is evaluated by an automatic selector block 24 to determine a measure of the signal 22 usefulness B. The usefulness measure (B) is then applied as a gain to the input signal T(t) 26, i.e. BT(t) to give the output 28.

The input signal may be a microphone, and the system may be applied to determine if an input signal is 'useful' as opposed to being, for example, wind noise. Alternatively, the system can be applied to an auxiliary FM receiver to determine if the FM transmitter is sending a useful signal or if it has been switched off or has gone out of range. As another alternative, the input signal could be provided by a telecoil and evaluation of the signal results in the gain being turned down if it is determined that the signal is resulting just from noise.

Figure 1B:
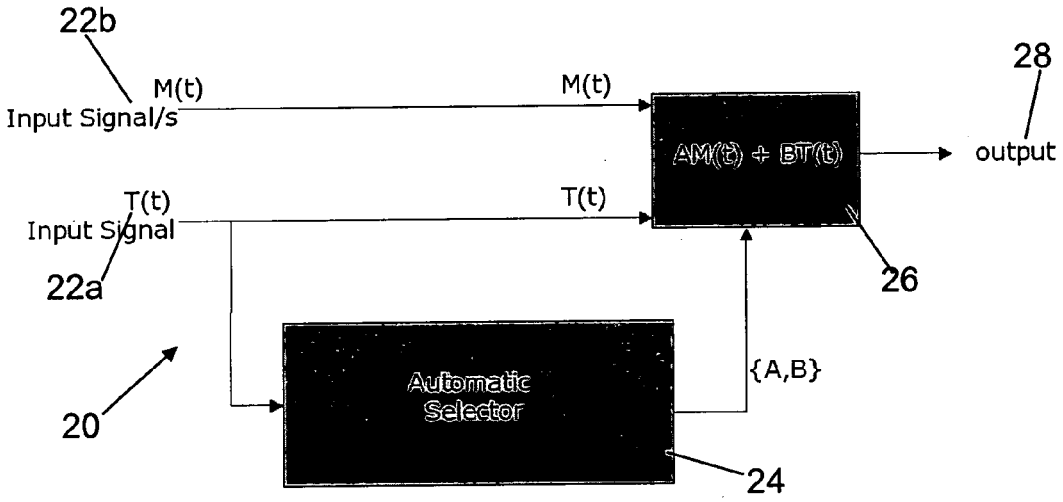
FIG. 1*b* is a block diagram overview of the system of another embodiment of the invention where there is at least two input signals.

FIG. 1*b* is a block diagram overview of a system 20 where there are at least two input signals 22*a*, 22*b*. The input signal of interest, in this case 22*a*, is evaluated by the automatic selector block 24 to determine a measure of its usefulness, B. This usefulness measure, B, can then be used as a measure of relative usefulness compared to the other input signal(s), the latter being characterized by A. The resulting output signal 28 may be one of the input signals or a combination of the multiple input signals, weighted in response to B.

Figure 1C:
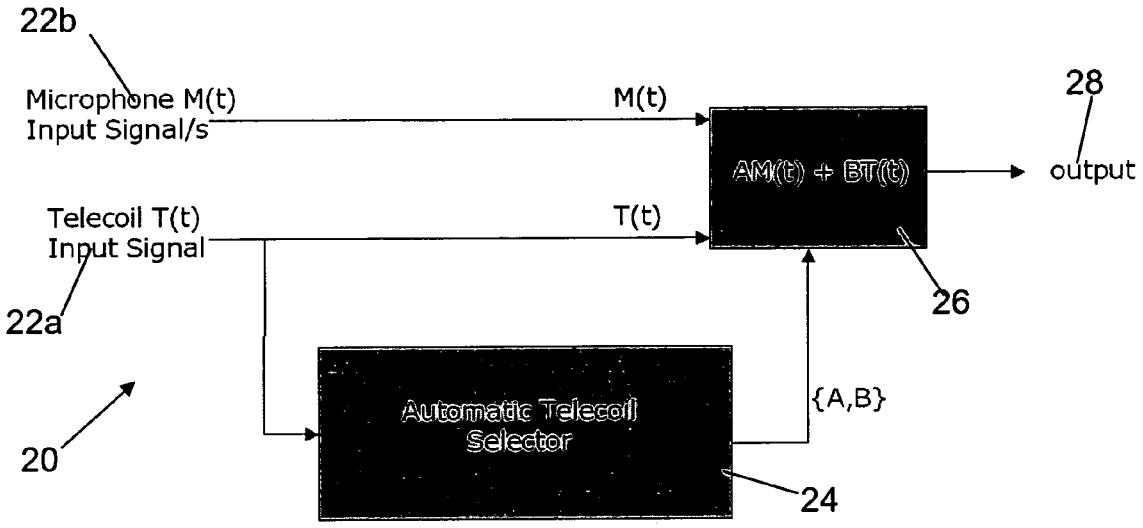
FIG. 1*c* is a block diagram overview of the system of FIG. 1*b*, wherein one signal is a microphone input signal and the other signal is a telecoil input signal.

FIG. 1*c* shows a situation similar to FIG. 1*b*, and illustrates the generation of an output signal on the basis of a microphone input signal M(t) 22*b* and a telecoil input signal T(t) 22*a*. Note that M(t) and T(t) can be a combination of multiple microphone and telecoil inputs respectively. The telecoil input signal T(t) 22*a* is passed through a processor that processes the telecoil input signal T(t) 22*a* to determine if it is useful for the auditory device. The telecoil input 22*a* is evaluated by the automatic selector block 24 which determines the linear ratio by which the telecoil signal 22*a* is mixed with at least one microphone signal 22*b* to give an output signal 28.

The usefulness of the telecoil input signal T(t) 22*a* in FIG. 1*c* is determined according to implementations of the present invention by parameters relevant to the change in spectral shape over time and the signal level, as will be further described below. In the implementations to be described, the evaluation of signal 'usefulness' is made on the basis of those parameters and a predetermined set of rules.

The output need not be a binary on/off decision, that is, to decide to use the telecoil signal T(t) 22*a* or the microphone signal M(t) 22*b*. The output can alternatively be some form of mixing ratio which can be translated into the ratios {A,B} where B represents the proportion of telecoil signal T(t) 22*a* and A represents the proportion of microphone signal M(t) 22*b*, so as to produce a combination of the signals M(t) and T(t). In other words, the output signal is AM(t)+BT(t).

If the telecoil signal T(t) 22*a* is determined to be 'useful', then its level can be increased compared to the microphone signal M(t) 22*b* (i.e. increase B with respect to A). If the telecoil signal T(t) 22*a* is determined to be not 'useful' (e.g. it is noisy), its level can then be decreased as a proportion of the final signal (i.e. decrease B with respect to A). Note that M(t) and T(t) may be pre-processed signals, e.g. algorithms such as beam-forming or other noise reduction systems may be applied to the M(t) signal prior to mixing with the telecoil signal T(t), or the T(t) signal may be band-limited to within a range of interest (e.g. <3 kHz). Such pre-processing is well known in the art and will not be discussed further in this application. It will be appreciated that the mixing process described is only one alternative, and other mixing processes may be applied to the input signals.

According to the presently described implementation, the evaluation of the telecoil signal T(t) 22*a* to determine its usefulness is made on the basis of the change in the spectral shape of the input signal over time combined with a measure of signal strength. The inventors have determined upon the use of the change in spectral shape of the signal over time because although the amplitude of magnetic noise signals can change with the orientation of the telecoil in the field, the shape of the frequency spectrum (in effect, the ratio of one frequency band amplitude to another), tends to stay constant with change of orientation. Furthermore, by noting that the vast majority of magnetic noise sources have a very constant spectral shape, we can determine that a signal is 'useful' by using this property of telecoil noise rather than any particular property of the speech or music signal.

The implementation in FIG. 1*c* can also be applied to the situation where the input signals come only from two or more telecoils. Each telecoil may be provided with a detector circuit, or only one telecoil. In the latter case, sound signals associated with each telecoil are received, and the resulting output signal could result from either the most appropriate input signal received from all the telecoils, or the combination of two or more of the telecoil input signals.

Figure 2:
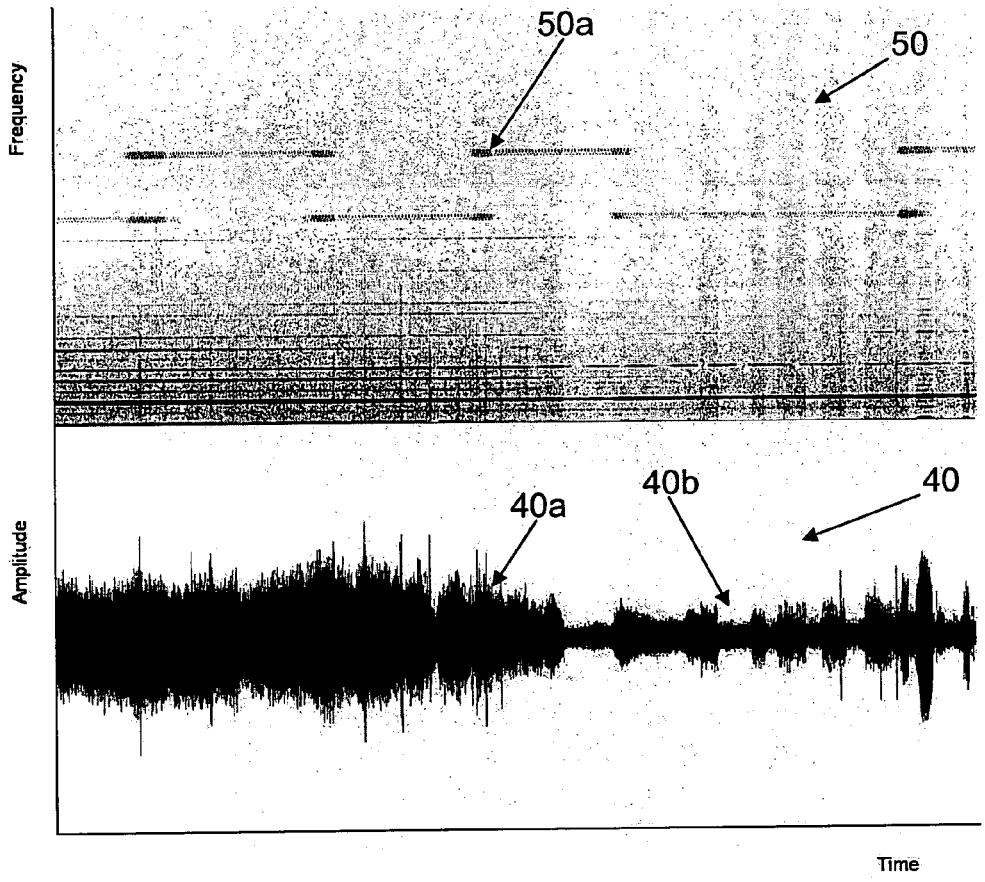
FIG. 2 shows both the time domain waveform and frequency spectrum of a telecoil recording made sitting on a train.
Figure 3:
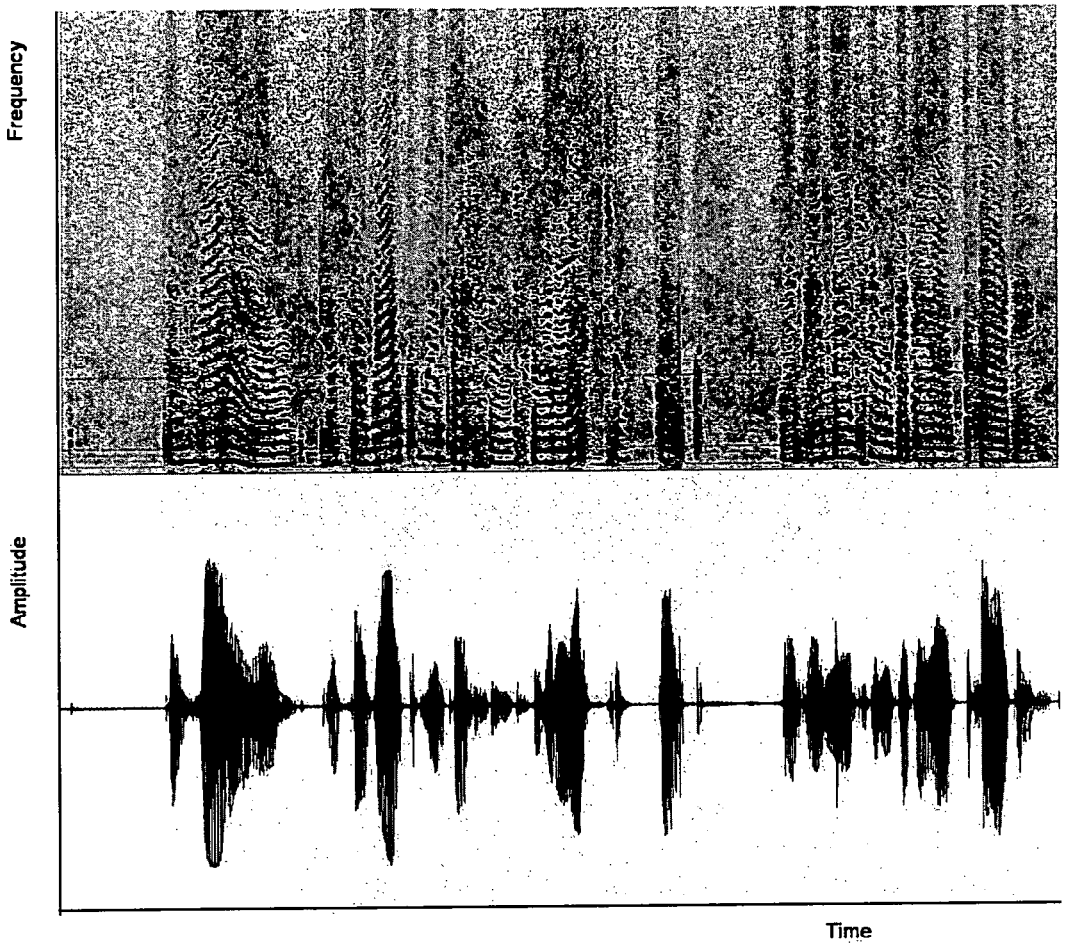
FIG. 3 shows both the time domain waveform and frequency spectrum of a telecoil recording of a phone call made using a hearing aid compatible telephone.

Examples of a telecoil signal recorded from two different environments, which may be used to determine the usefulness of the signal, are shown in FIGS. 2 and 3.

FIG. 2 shows a telecoil recording made sitting on a train. During the recording, the telecoil was rotated slowly in the magnetic field in the latter half of the recording. It can be seen that the amplitude of the time domain waveform 40 varies greatly in the first half of the recording 40*a* compared to the second half of the recording 40*b*, whereas the frequency of the peaks 50*a* (i.e. the vertical location of the darkest points in the frequency spectrum 50) remains very constant.

FIG. 3 shows a telecoil recording of a phone call made using a hearing aid compatible telephone. The signal is a strong, relatively noise-free signal that is likely to be desirable and useful to a recipient of an auditory prosthesis. In this case the frequency of the peaks (i.e. the vertical location of the brightest points) varies greatly. Whilst the level of the signal is important, it is to be noted that the changing of the spectral shape over time is the dominant factor in evaluation of the usefulness of the telecoil signal T(t) 22*a*.

Therefore, the algorithm shown in the following example uses a combination of information concerning the spectral shape variation and time domain signal level to evaluate the usefulness of the telecoil signal T(t) 22*a*. In cases where the signal level is high, telecoil noise signals will exhibit a low degree of spectral shape variability whereas speech and music have a high degree of spectral shape variability. Conversely, in cases where the signal level is very low, the spectrum may exhibit high shape variability since there may not be a dominating static noise signal. In these cases, it is unlikely that a good speech or music signal is present. Thus the algorithm combines these two factors together, determining that a good signal is present if the signal level is high and the spectral shape is non-stationary.

Figure 4:
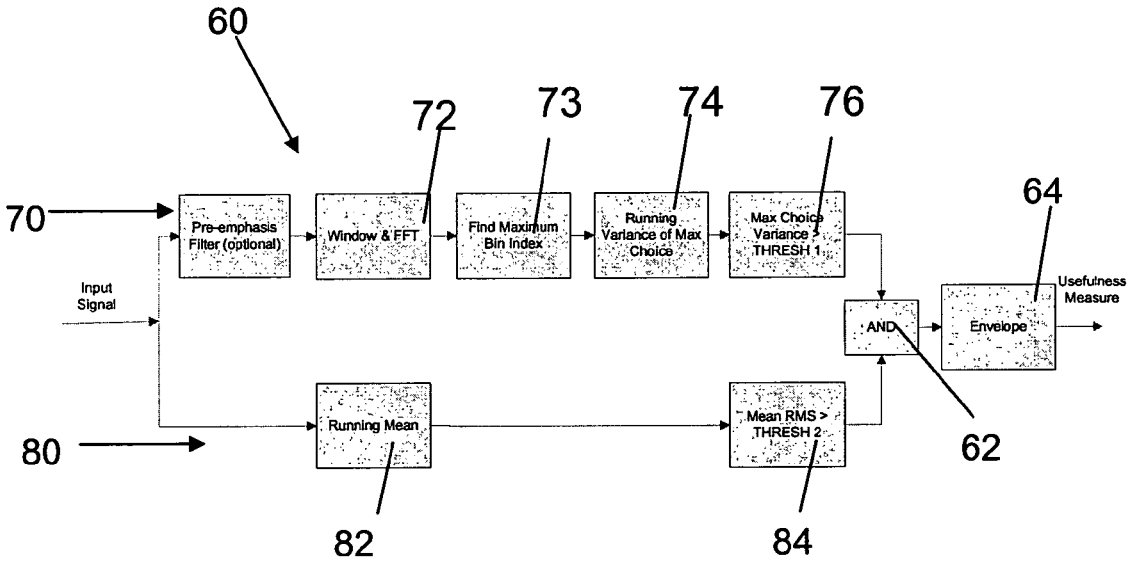
FIG. 4 is a block diagram illustrating a method for determining the usefulness of an input signal in accordance with one embodiment.

The algorithm is represented in FIG. 4 as a schematic for automatic evaluation of an input signal to determine whether or not that signal is 'useful1 to the auditory device. In the upper row 70 of the block diagram 60, the variation of the spectral shape over time is evaluated (i.e. how stationary the spectral shape is), while in the lower row 80, the signal level is evaluated.

A variety of techniques to measure how stationary the spectral shape is may be selected. As shown by the upper row 70 of the algorithm 60 in FIG. 4, one method performs a fast Fourier transform (FFT) 72, finds the maximum bin index 73, and then calculates a running variance of the index of the maximum amplitude FFT bin 74. This calculation of the running variance ($X_{var}$) may be calculated according to the following equations:

$$X[n] = \text{index}(\max(FFT(T)) \qquad \text{Equation 1}$$

$$M_u[n] = \frac{1}{K}X[n] + \left(1 - \frac{1}{K}\right)M_u[n-1] \qquad \text{Equation 2}$$

$$X_{Var}[n] = \frac{1}{K}(X[n] - M_u[n])^2 + \left(1 - \frac{1}{K}\right)X_{Var}[n-1] \qquad \text{Equation 2}$$

where T is a moving window of samples from the input signal and K is a constant which sets the rate of change of the variance measure.

The main benefit of this approach is that it is independent of any change in signal strength, and is only dependent on the shape of the frequency spectrum, i.e. the relative amplitudes of the frequency bands. Thus it should be robust to changes in orientation of the telecoil within a static magnetic noise field, such as the example shown in FIG. 2.

In this particular method of measurement of spectral shape, only the location of the spectral peak is being considered rather than the full spectral shape. This does have some distinct advantages. Not only does it result in a very low computational complexity, but it means that the measure is focused on the dominant element of the signal (i.e. the peak) and is thus more robust to background noise signals; hence the reason that the change in spectral shape over time is of greater importance than signal level.

Once the running variance has been calculated 74, if the variance is greater than a predetermined amount (THRESH 1) 76 then the variation of spectral shape is enough for the telecoil signal T(t) 22*a* to be considered as a proportion of the output signal to be used.

Alternative methods to measure the variance of the spectral shape may of course also be used. For example, (i) a measurement of the distance between a running peak and trough of the spectral measure, (ii) a measurement of the distance between the peak and mean in a window of spectral measure values, or (iii) comparing successive histograms of the spectral measure gathered over a time window.

Turning to the lower branch 80 of the algorithm 60, the signal level is determined by a running mean RMS 82, although any alternative level measure, for example an alternative slow-moving measure, would also work. The running mean RMS (RunMean) can be calculated as follows:

$$RMS[n] = \sqrt{\sum_{W} T[w]^2} \qquad \text{Equation 4}$$

$$RunMean[n] = \frac{1}{K}RMS[n] + \left(1 - \frac{1}{K}\right)RunMean[n-1] \qquad \text{Equation 5}$$

where 7 is a moving window of samples of length W from the input signal and K is a constant.

If the running mean is greater than a predetermined amount (THRESH 2) 84 then the signal level is high enough for the telecoil signal T(t) 22*a* to be considered as a proportion of the output signal to be used. The level measure and spectral variation measure are then combined together using an AND operation 62 to give a binary value.

The binary value from the AND output is passed through a simple envelope detector 64 which outputs a mixing ratio for the telecoil input. A binary 1 decision at the input to the envelope detector 64 will cause the highest telecoil mixing ratio. Whereas a binary 0 decision at the input to the envelope detector 64 will cause the mixing ratio to decrease at a predefined slew-rate.

It may be preferable in some uses for further post-processing of the usefulness measure to determine the final telecoil and microphone gains. For example, the telecoil may be left off until the two measures are determined to be above their respective thresholds for a period of time, or holding the telecoil on until either or both measures have been below their respective thresholds for a period of time.

Figure 5:
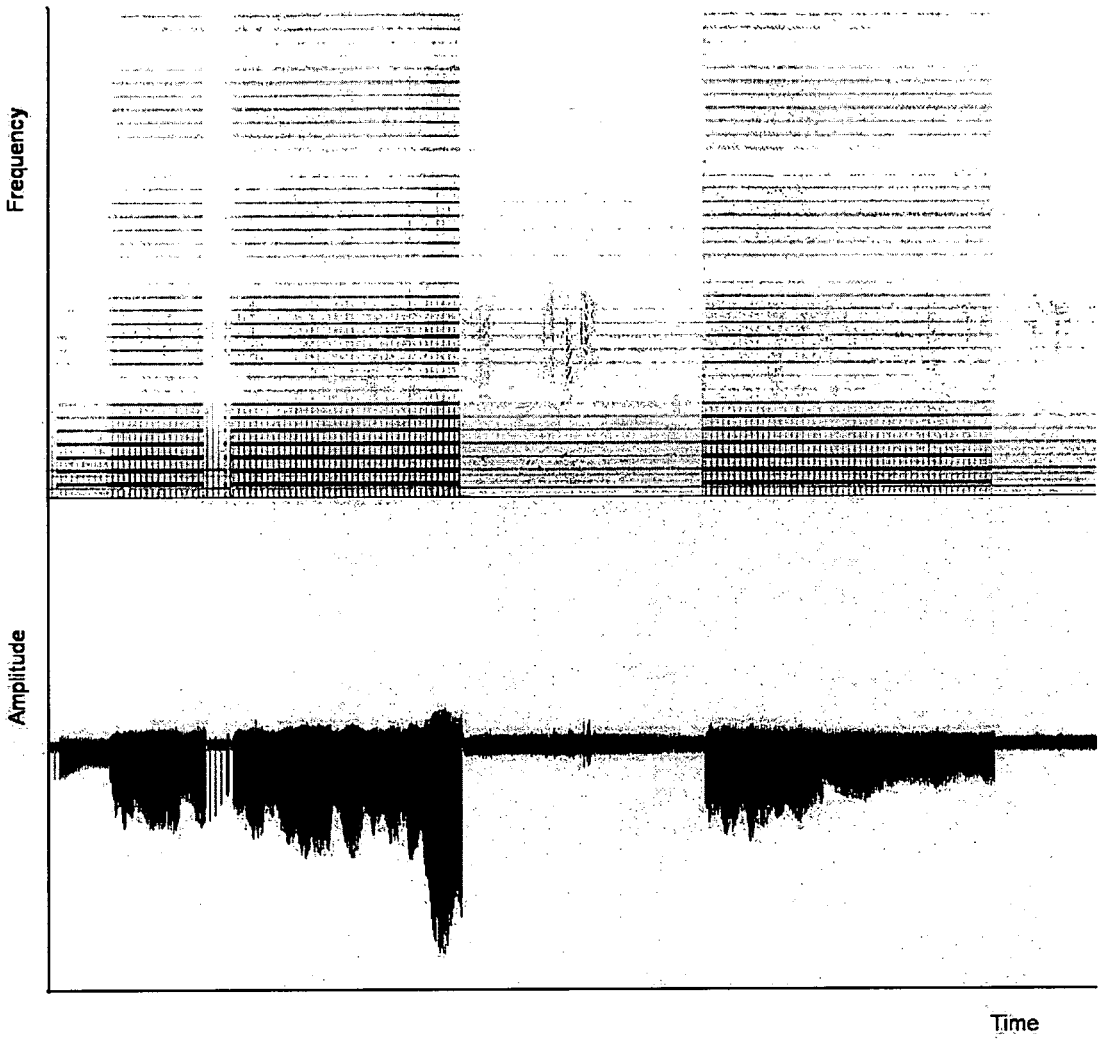
FIG. 5 shows both the time domain waveform and frequency spectrum of a telecoil recording of a phone call made using a mobile phone held next to the telecoil.

If a speech signal is strong and there is a comparatively low level magnetic noise signal then there will be a high variability in the location of the spectral peak and so the telecoil signal will be selected. Whereas, if there is a very strong interfering noise signal which masks the speech (i.e. is of higher level than the speech) then there will be very little variability in the location of the spectral peak and so the telecoil signal will not be selected. An example of this latter scenario is shown in FIG. 5. Since the particular signal in FIG. 5 is a fairly unintelligible signal due to the presence of such high level noise, it will be a good decision not to select the telecoil signal in that case. Thus the evaluation of the telecoil signal not only detects a signal on the telecoil, but makes an assessment of how good that signal is before selecting it.

Figure 6:
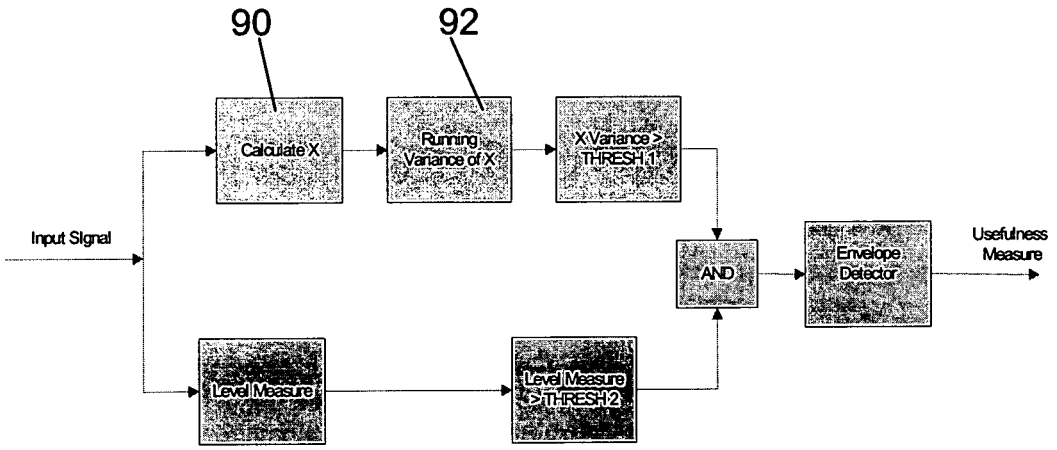
FIG. 6 is a block diagram illustrating a method for the evaluation of an input signal in accordance with another embodiment.

There are a variety of methods to determine the variation of the spectral shape over time, rather than only that described above. One or more of these parameters may be used to assess the variation in spectral shape over time, as required for implementations of the present invention. A block diagram of how any such measure of spectral shape (X) could be used is given in FIG. 6. In this case, the index of the maximum FFT bin has been replaced with any spectral shape measure (X) 90, or a function of the spectral shape measure (X) 90. The variance of (X) 92 gives another measure of the variability of the spectral shape.

Some examples of other measures which could be substituted for X are:

- A time domain zero-crossing count (ZCC) (or log of the ZCC)—this gives a very rough estimate of the frequency content of a signal. Thus a highly variable zero-crossing count should indicate a highly variable spectral shape. Similarly to the FFT bin index, this will be independent of signal amplitude and thus robust to changes in orientation or movement of the device.
- The Spectral Centroid—This is a frequency value produced by taking an average of the frequency bin components weighted by their amplitudes. Similarly to the spectral peak, it gives a measure of the frequency location of the dominant frequency information in the signal that depends on the relative amplitudes of the frequency components when compared to one another rather than the actual amplitudes themselves.
- An amplitude-weighted measure of the frequency or FFT index of the N highest frequency peaks.
- The peak, spectral centroid or other measure of the dominant frequency content as calculated using any other filterbank structure including FIR, MR and wavelet filterbanks.
- An estimate of the pitch or fundamental frequency The running variance of X can also be calculated using a low pass filtered, down-sampled or other slow moving measure of the variability of parameter X.

Any other power or level measure, whether slow-moving or not, could also be substituted for the running mean.

Figure 7:
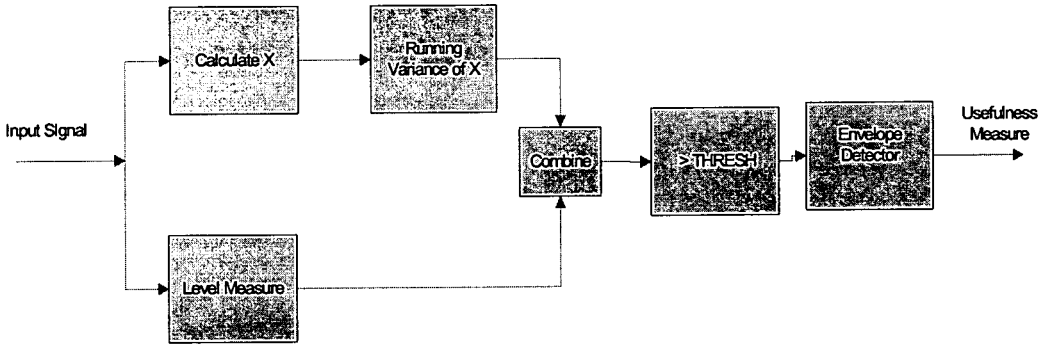
FIG. 7 is a block diagram illustrating a method for the evaluation of an input signal in accordance with another embodiment in which there is combined thresholding rather than individual thresholds for the parameters being measured.

Another variation of the algorithm would combine the outputs of the level measure and the spectral shape variability measure using some combination of multiplication, addition and/or normalization and then threshold the combined result rather than thresholding the two separately. This variation is shown in FIG. 7.

Figure 8:
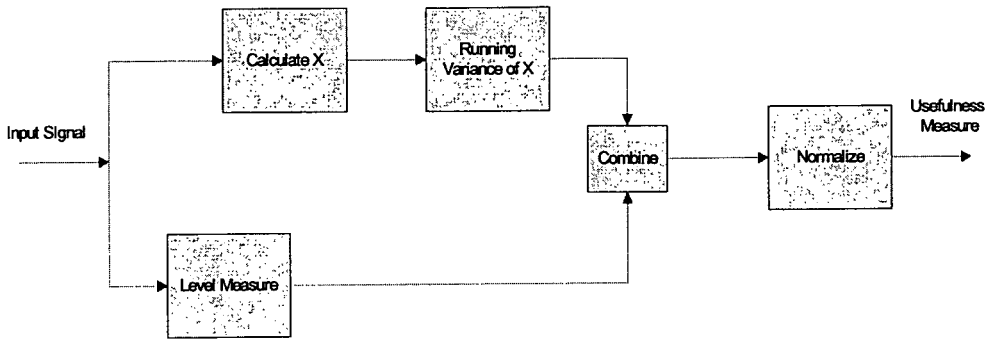
FIG. 8 is a block diagram illustrating the method for the evaluation of an input signal in accordance with yet another embodiment in which there is no thresholding of the parameters.

A further variation, shown in FIG. 8, would remove the need for thresholding altogether. Instead, the outputs of the level measure and the spectral shape variability measure could be combined using some combination of multiplication, addition and/or normalization and then converted directly into a mixing ratio.

Figure 9:
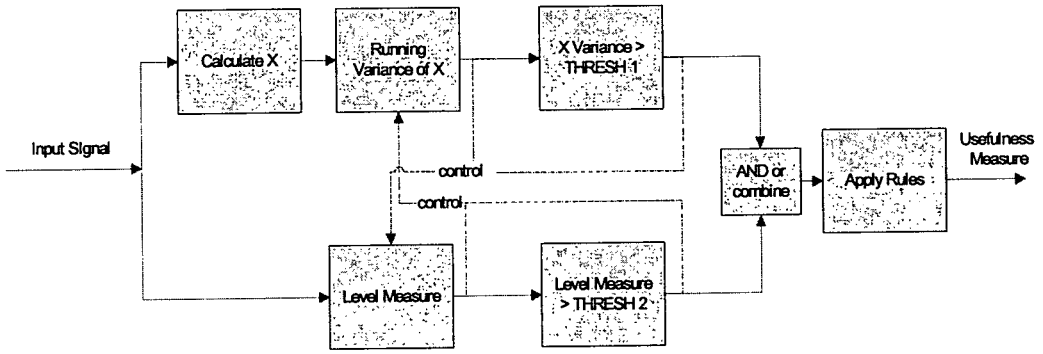
FIG. 9 is a block diagram illustrating the method for the evaluation of an input signal in accordance with a further embodiment in which the signal level controls the shape parameter measurement.

The block diagram in FIG. 9 illustrates yet another variation of the algorithm. In this variation, the signal level measure may be used to control an aspect of the calculation of the spectral variance measure, and/or vice versa. For example, the signal level measure may control the speed of the spectral shape variability measure.

Figure 10:
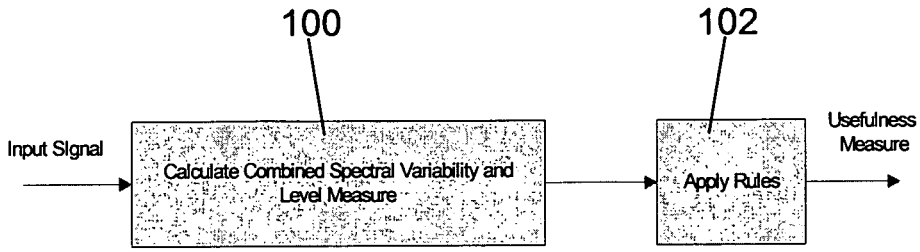
FIG. 10 is a block diagram illustrating the method for evaluation of an input signal in accordance with yet a further embodiment in which the signal level and shape parameter measurement are integrated.

In the above described embodiments, the signal level and the spectral shape variability measures have been determined and the rules applied independent of each other. However, it should also be appreciated that the signal level may be combined with the spectral shape variability to calculate the applicable parameters. This embodiment is illustrated in the block diagram of FIG. 10, where a combined spectral variability and signal level is calculated 100 prior to applying the relevant predetermined rules 102 to determine the usefulness of the input signal. For example, calculating the variation only between frames of a sufficiently high signal level may be performed, or use of a zero-crossing count with an initial offset applied.

Whilst embodiments of the present invention has been primarily described with reference to a decision between a telecoil signal and a microphone signal, it will be understood that embodiments of the present invention may be equally applied to any decision process for selection between multiple audio inputs. Further, whilst the embodiments discussed provide a fully automated selection process, it would be possible to implement the invention in a mode where the change of inputs is presented as an option, where the device considers it viable, via the usual interface from the device to the user.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. It will be appreciated that embodiments of the present invention is of a broad scope and can be implemented not only on current auditory devices such as hearing aids and cochlear implants, but will be capable of application to future generations of cochlear implants and totally implanted devices and to stages between the two. Additionally, a person skilled in the art will also see how this same technique can be applied to input signals provided by varying devices to those described above.

The invention claimed is:

1. A method for automatic evaluation of an input signal for use in an auditory device, the method comprising:

detecting a signal;

processing said signal to determine a variance of frequency spectral shape over time of said signal, and a signal level;

on the basis of comparing the variance and the signal level to at least one predetermined threshold, evaluating whether said signal is a useful input signal for said device.

2. The method of claim 1, wherein the variance is derived from either the ratio of frequency band amplitudes or another estimate of the dominant frequency content of the signal.

3. The method according to claim 1, wherein more than one input signal is evaluated, and on the basis of said evaluation a selection is made between said input signals.

4. The method according to claim 3, wherein the selection between said input signals includes selecting one of the input signals, or selecting a combination of the multiple input signals.

5. The method according to claim 3, wherein the input signals are mixed for further processing, and the proportion of the mixed signal relating to the selected input signal is increased.

6. The method according to claim 3, wherein one or more of the input signals are pre-processed before evaluation.

7. The method according to claim 1, wherein determining the variance of spectral shape over time of said signal includes performing a fast Fourier transform (FFT) and running variance of an index of the FTT maximum amplitude.

8. The method according to claim 1, wherein determining the variance of spectral shape over time of said signal includes determining the variance independent of any change in signal strength.

9. The method according to claim 7, wherein only the location of the spectral peak is considered.

10. The method according to claim 1, wherein the signal level is determined by a running mean RMS.

11. The method according to claim 1, wherein the auditory device is a cochlear implant prosthesis.

12. The method according to claim 1, wherein said input signal is chosen from the group comprising:

one or more telecoil signals, one or more microphone signals, or a combination of one or more telecoil and microphone signals.

13. The method according to claim 1, wherein evaluating the input signal includes detecting whether an input signal is present and assessing how useful the input signal is before generating the output signal based at least partially on the input signal.

14. An auditory device wherein the device is adapted to automatically evaluate an input signal, said device comprising:

a detector for detecting a signal, a processor for processing said signal to determine a variance of frequency spectral shape over time of said signal, and a signal level, on the basis of comparing the variance and the signal level to at least one predetermined threshold, evaluating whether said signal is useful for said device.

15. The auditory device according to claim 14, wherein the variance is derived from either the ratio of frequency band amplitudes or another estimate of the dominant frequency content of the signal.

16. The auditory device according to claim 14, wherein the device is adapted to receive more than one input signal, to evaluate each said input signal, and to select from said input signals on the basis of said evaluation.

17. The auditory device according to claim 16, wherein the selection between said input signals includes selecting one of the input signals, or selecting a combination of the multiple input signals.

18. The auditory device according to claim 16, wherein the input signals are mixed for further processing by said device, and the proportion of the mixed signal relating to the selected input signal is increased.

19. The auditory device according to claim 16, wherein one or more of the input signals are pre-processed before evaluation.

20. The auditory device according to claim 14, wherein determining the variance of frequency spectral shape over time of said signal includes performing a fast fourier transform (FFT) and running variance of an index of the FTT maximum amplitude.

21. The auditory device according to claim 14, wherein determining the variance of frequency spectral shape over time of said signal includes determining the variance independent of any change in signal strength.

22. The auditory device according to claim 20, wherein only the location of the spectral peak is considered.

23. The auditory device according to claim 14, wherein the signal level is determined by a running mean RMS.

24. The auditory device according to claim 14, wherein the auditory device is a cochlear implant prosthesis.

25. The auditory device according to claim 14, wherein said input signal is chosen from the group comprising:

one or more telecoil signals, one or more microphone signals, or a combination of one or more telecoil and microphone signals.

26. A method for automatic evaluation of an input signal for use in an auditory device, the method comprising:

detecting an input signal;

processing said signal to determine a variance of spectral shape of said signal's frequency spectrum, and a signal level of said signal;

comparing the variance with a first predetermined threshold;

comparing the signal level with a second predetermined threshold; and if the variance is higher than the first predetermined threshold and the signal level is higher than the second predetermined threshold, generating an output signal based at least partially on the input signal.

27. The method of claim 26, wherein the variance is derived from either the ratio of frequency band amplitudes or another estimate of the dominant frequency content of the signal.

28. The method according to claim 26, wherein more than one input signal is evaluated, and on the basis of said evaluation a selection is made of one of the input signals or a combination of the multiple input signals.

29. The method according to claim 28, wherein the input signals are mixed for further processing, and the proportion of the mixed signal relating to the selected input signal is increased.

30. The method according to claim 26, wherein determining the variance of spectral shape of said input signal's frequency spectrum includes determining the variance independent of any change in signal strength.

31. The method according to claim 30, wherein only the location of the spectral peak is considered.

* * * * *